US007635420B1

(12) United States Patent
Li et al.

(10) Patent No.: US 7,635,420 B1
(45) Date of Patent: Dec. 22, 2009

(54) DIELECTROPHORESIS-BASED PARTICLE SENSOR USING NANOELECTRODE ARRAYS

(75) Inventors: Jun Li, Sunnyvale, CA (US); Alan M. Cassell, Campbell, CA (US); Prabhu U. Arumugam, Sunnyvale, CA (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 532 days.

(21) Appl. No.: 11/645,267

(22) Filed: Nov. 21, 2006

(51) Int. Cl.
*B03C 5/02* (2006.01)

(52) U.S. Cl. ..... 204/547; 204/643

(58) Field of Classification Search ..... 204/547, 204/643; 977/902, 904, 920, 924, 938
See application file for complete search history.

(56) References Cited

U.S. PATENT DOCUMENTS 6,764,583 B2 * 7/2004 Miles ..... 204/452

OTHER PUBLICATIONS

Gray, Darren et al. Dielectrophoretic registration of living cells to a microelectrode array, Biosensor and Bioelectronics, 2004, 19, 771-780.*

Li, Jun et al. Carbon Nanotube Nanoelectrode Array for Ultrasensitive DNA Detection, Nano Letters, Mar. 2003, 597-602.*

Andersson, H., et al., Microfluidic Devices for Cellomics: A Review, Elsevier, 2003, 315-325, Elsevier Science B.V.

Li, H., et al., On the Design and Optimization of Micro-Fluidic Dielectrophoretic Devices: A Dy . . . , Biomedical Microdevices, 2004, 289-295, 6-4, Kluwer Academic Publishers.

Li, H., et al., Characterization and Modeling of a Microfluidic Dielectrophoresis Filter for Biol . . . , J. Microelectromechanical Systems, Feb. 2005, 103-112, 14-1, IEEE.

(Continued)

*Primary Examiner*—Brian J Sines
*Assistant Examiner*—Gurpreet Kaur
(74) *Attorney, Agent, or Firm*—John F. Schipper; Robert M. Padilla

(57) ABSTRACT

A method for concentrating or partly separating particles of a selected species from a liquid or fluid containing these particles and flowing in a channel, and for determining if the selected species particle is present in the liquid or fluid. A time varying electrical field E, having a root-mean-square intensity $E^2_{rms}$ with a non-zero gradient in a direction transverse to the liquid or fluid flow direction, is produced by a nanostructure electrode array, with a very high magnitude gradient near exposed electrode tips. A dielectrophoresis force causes the selected particles to accumulate near the electrode tips, if the medium and selected particles have substantially different dielectric constants. An insulating material surrounds most of each of the nanostructure electrodes, and a region of the insulating material surface is functionalized to promote attachment of the selected species particles to the surface. An electrical property value Z(meas) is measured at the functionalized surface and is compared with a reference value Z(ref) to determine if the selected species particles are attached to the functionalized surface.

28 Claims, 7 Drawing Sheets

OTHER PUBLICATIONS

Minerick, A., et al., Manipulation and Characterization of Red Blood Cells With Alternat . . . , Electrophoresis, 2003, 3703-3717, 24WILEY-VCH Verlag GmbH & Co. KgaA, Weinheim.

Pohl, H., The Motion and Precipitation of Suspensoids in Divergent Electric Fields, J. Applied Physics, Jul. 1951, 869-871, 22-7, AIP.

Yang, et al., Impedance Based Biosensor with Dielectrophoresis . . . , Solid-State Sensors, Actuators, and Microsystems Workshop, Jun. 4-8, 2006, Hilton Head Island, South Carolina.

* cited by examiner

DIELECTROPHORESIS-BASED PARTICLE SENSOR USING NANOELECTRODE ARRAYS

FIELD OF THE INVENTION

This invention relates to use of nanostructure electrode arrays and non-constant electrical fields to sense presence of a selected species particle.

BACKGROUND OF THE INVENTION

Sample preparation is one of the key functions in detection of biologically important organisms. It involves controlled separation, concentration, and/or manipulation of desired particles from a matrix of interferents. Traditionally, it is performed through separate, standalone centrifugation, magnetic manipulation and filtration systems and then transferred to a detector. The main disadvantages are cross-contamination, slow operational speed, high cost and the need for skilled personnel. Recent efforts are towards the development of lab-on-a-chip systems ("LOC") with on-chip sample preparation and detection capabilities. Although LOC offers advantages of reduced reagent consumption and reduced waste generation, multiplexing, portability and scalability, the integration of on-chip sample preparation is yet to be realized. This is because of the necessity of processing large sample volumes that is difficult in existing chip platforms. Technologies that can seamlessly integrate sample processors to LOC and that can handle large sample volumes for a fully automated; rapid real-time monitoring is critically needed for health and environmental monitoring applications.

What is needed is a method and associated system for accumulating and concentrating a selected species that provides reasonably high throughput and good selectivity and should not require a large "footprint" in order to operate. Preferably, the approach should extend to a large class of species, should not require that the selected species be electrically charged or labeled with functional moieties, and should allow use of smaller voltages for operation.

SUMMARY OF THE INVENTION

These needs are met by the invention, which uses dielectrophoresis (DEP) effects in a non-uniform non-constant electrical field, produced by an array of spaced apart nanostructures ("NSs") located on a substrate surface, to control particle separation on a chip. The array of NSs, acting as first electrodes, preferably has a density in a range of $10^6$-$10^{12}$ $cm^{-2}$ (spacing of 10 nm-10 μm), with associated non-uniform non-constant electrical fields with magnitude ranges of $10^3$-$10^8$ Volts/cm. A second electrode is spaced apart from the first electrodes by a distance d≈1-1000 μm, and a fluid flows in a channel C lying between and defined by the first electrodes and second electrode.

The first electrodes are driven by a time varying voltage of $\pm V_e$ ($V_e$=5-100 Volts) relative to the second electrode so that an electrical field vector E(x,y,z,t) that varies with z is created, directed primarily along a z-axis perpendicular to at least one of a first surface defined by an exposed surface of the (first) NS electrodes and by a second surface defined by the second electrode, with $\partial(E^2)/\partial z \neq 0$. There are also significant electrical field vector components E(x,y,z,t) that vary with x (along the fluid flow direction in the channel) and with y (perpendicular to the fluidic flow direction in the channel but parallel to the first surface), with $\partial(E^2)/\partial x \neq 0$ and $\partial(E^2)/\partial y \neq 0$ in the proximity of the NSs. The first surface and second electrode surfaces define a channel with spacing $d_{1,2}$≈1-1000 μm, which may contain a selected species particle of interest (e.g., a bacterium, or other biological or nonbiological material) and contains a fluid (collectively referred to as "medium") that is not of interest here. One object of the invention is to promote an accumulation (and thus concentration) of the selected particle (e.g., biological species such as *E. coli*, salmonella, anthrax, tobacco mosaic virus or herpes simplex, and nonbiological materials such as nano- and micro-particles, quantum dots, nanowires, nanotubes, and other inorganic particles) adjacent to the first surface.

Another object is to provide a sensor that detects presence of a selected species particle in the channel liquid or fluid. This is accomplished by: (1) providing an insulating material, having an insulating material surface, in an interstitial volume between two or more adjacent NS electrodes; (2) providing a functionalizing substance, located on a selected region of the insulating material surface, which promotes attachment of the selected species particles to the functionalized surface; (3) measuring a selected electrical property, such as electrical impedance or conductance or capacitance, with a value Z(meas) at the functionalized surface and comparing the measured value with a reference value Z(ref) for this surface; (4) comparing a selected difference-based value ΔZ(meas), involving Z(ref)−Z(meas), with a threshold difference value ΔZ(thr); (5) when $|\Delta Z(meas)| \geqq \Delta Z(thr)$, interpreting this condition as indicating that the selected species particles are attached to the functionalized region (and thus is present in the liquid or fluid); and (6) when $|\Delta Z(meas)| < \Delta Z(thr)$, interpreting this condition as indicating that the selected species particles are not attached to the functionalized region, or are present in a below-threshold number.

One key advantage is that an array of NS electrodes can provide an electric field intensity gradient, particularly $\partial(E^2)/\partial z$, that is one or more orders of magnitude greater than the corresponding gradient provided by a conventional microelectrode arrangement.

Another key advantage of this technology is that, as a result of the high magnitude field intensity gradients, an NS concentrator can trap particles from high speed microfluidic flows. This is critical for applications where the entire analysis must be performed in a few minutes. Another key advantage is the platform technology can be integrated into a "lab-on-a-chip" device that greatly facilitates on-chip sample preparation and complete automation, a prerequisite for continuous real-time monitoring.

BRIEF DESCRIPTION OF THE DRAWINGS

FIGS. 5(*a*), 5(*b*), and 5(*c*) are representative microelectrode DEP layouts from prior arts, while 5(*d*) and 5(*e*) are an NS electrode array (NSEA) of this invention. In FIG. 5(*a*) both the first and second electrodes are microelectrodes which are laid at the bottom of the microfluidic channel and interdigitized with each other. In FIGS. 5(*b*) and 5(*c*) parallel microelectrodes are laid at the bottom of the microfluidic channel and used as the first electrode vs. a second macroelectrode at the top of the fluidic channel. Both FIGS. 5(*d*) and 5(*e*) use NAEA at the bottom of the fluidic channel as the first electrode vs. a second macroelectrode at the top of the channel. FIG. 5(*d*) uses a single NSEA while 5(*e*) uses two or more separately addressed multiplex NSEAs.

DESCRIPTION OF BEST MODE OF THE INVENTION

Figure 1:
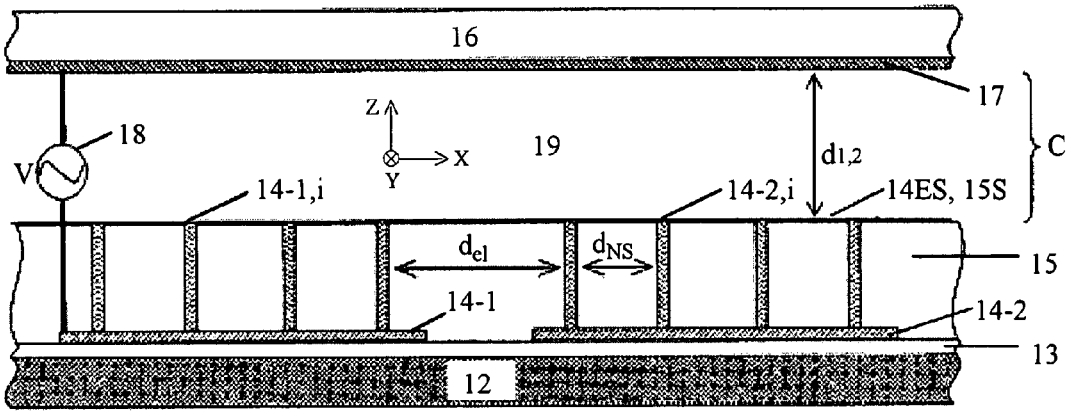
FIGS. 1 and 2 schematically illustrate two embodiments of the invention.

FIG. 1 schematically illustrates an embodiment 1 of the invention, which includes a substrate 12, a thin insulating first layer 13 (e.g., $SiO_2$, $Si_3N_4$, or other) contiguous to a surface of the substrate 12, and an array of spaced apart (first) electrodes 14-*i* (i=1, . . . , I; I≧1), with each electrode 14-*i* having an a sub-array of at least first and second spaced apart nanostructure ("NS") electrodes 14-(*i*,*j*) (j=1, . . . , J; J≧2). Optionally, interstitial regions between adjacent NSs 14-(*i*,*j*) on the same electrode and/or between adjacent electrodes 14-*i* are partly or wholly filled with an insulating material 15 (e.g., $SiO_2$, $Si_3N_4$, epoxy or other), and the insulating material 15 is planarized by mechanical polishing, chemical etching, chemical mechanical polishing, or plasma etching so that tips of the NSs are exposed, collectively forming an exposed surface 14ES of the electrodes 14-*i*. The NSs 14-(*i*,*j*) may be multi-wall carbon nanotubes ("MWCNTs") or carbon nanofibers ("CNFs"), another carbon-based nanostructure, or a conducting nanostructure not including carbon. The exposed tip of individual NS 14-(*i*,*j*) may be in the surface plane 15S, slightly recessed from the surface 15S, or slightly protrude over the surface 15S.

A thin material 16 with a flat surface (e.g., glass, quartz, plastic, or other) is spaced apart from the exposed surface 14ES by a selected distance $d_{1,2}$≈1-1000 μm, and a second electrode 17 is located between the exposed surface 14ES and the thin material 16, contiguous to the thin material. The first electrodes 14-(*i*,*j*) and the second electrode 17 are connected to positive and negative terminals of a voltage source 18, which preferably provide a time varying voltage difference ΔV(t)≈(±) 0.5-100 Volts (undulating, with one or more frequencies ω in a range 100 Hz-100 MHz) between the first electrodes 14-*i* and the second electrode 17. This voltage provides an electrical field E=E(x,y,z,t) for which a large component $\partial(E^2)/\partial z \neq 0$, where z is a Cartesian coordinate, oriented substantially perpendicular to a first electrode surface or to a second electrode surface, as in FIG. 1, and the separation distance between exposed surface 14ES and the second electrode 17 is $d_{1,2}$≈1-1000 μm.

A liquid or fluid 19, which may contain a selected species particle of interest and contains a medium that is not of interest, flows in the channel C. With the voltage source 18 activated, DEP action causes some particles (characterized as DEP-positive, e.g. bacterium) with a dielectric permittivity larger than that of the medium (e.g., water) to move toward the NSEA, while other particles (characterized as DEP-negative, e.g. insulating inorganic particles) with a dielectric permittivity smaller than that of the medium to move away from the NSEA. The DEP-positive particles may be accelerated toward the first electrode NSEA 14-*i* and then held at the first electrode surface by a DEP force component opposite to the drag force of the fluid while DEP-negative particles are subjected to a reduced DEP force as they move away from the NSEA. The DEP-negative particles are thus washed away due to the drag force of the fluid and can be collected in a first down-stream general medium reservoir. After accumulation for certain time at the NSEA, DEP-positive particles can be released by turning off or reducing the voltage source 18 and guided to a second down-stream selected species reservoir for further processing. The DEP-positive particles with substantially different dielectric constants can also be roughly separated by adjusting the amplitude of the applied voltage. The selected particle is to be attracted in a region adjacent to the exposed surface 14ES, using DEP forces in a direction primarily perpendicular to the exposed surface 14ES, and is then accumulated or concentrated in this region by a DEP force component parallel to the surface 14ES. This approach differs from the normal DEP devices, where the DEP forces on the selected particles are primarily parallel to a substrate surface. In the approach provided by this invention, the goal is to take advantage of the large perpendicular DEP force components so that the particles of the selected species can be quickly moved down to the first electrode surface within a small lateral travel distance. Once the selected species particles are brought to the proximity of the NSEA, the lateral DEP components are sufficient to held them in place so that the selected species is concentrated in a small region (here, adjacent to the exposed surface 14ES). The medium and other non-selected particles flow down stream and are collected in the general medium reservoir.

Figure 2:
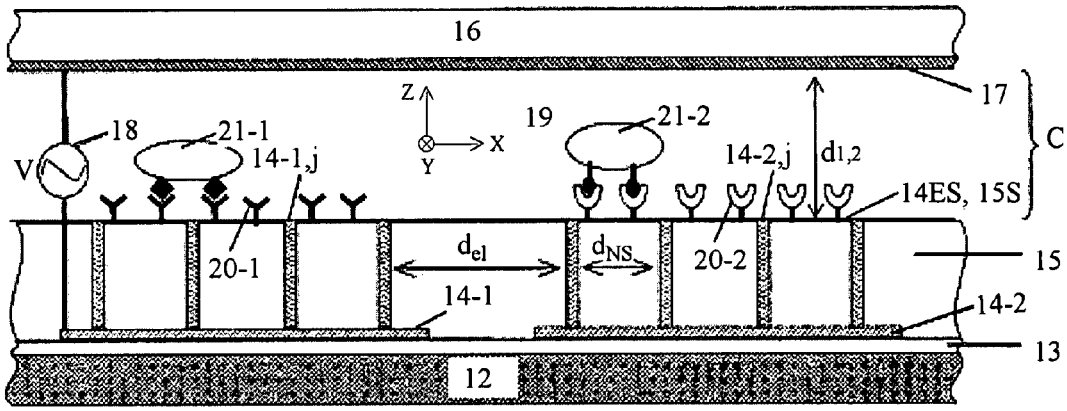

FIG. 2 schematically illustrates another embodiment 2 of the invention, in which the reference numbers 12, 13, 14-*i*, 14-(*i*,*j*), 14ES, 15, 16, 17, 18 and 19 are as in FIG. 1. The exposed surface 15S of the interstitial material 15 within each NSEA sub-array 14-*i* is functionalized with an antibody or similar functionalizing substance 20-*i* that interacts with and binds a selected bacterium, antigen or similar reactant 21-*i*. A first functionalizing substance 20-1 used for a first sub-array 14-1 may be the same as, or be different from, a second functionalizing substance 20-2 used for a second sub-array 14-2. Different reactants, 21-1 and 21-2, can be collected adjacent to the first and second sub-arrays, 14-1 and 14-2, if desired, or the same reactant can be collected at the first and second sub-arrays. After the reactants are collected at the sub-array 14-*i*: (1) the general medium and non-selected particles in the medium flow through the channel and are received in a first general medium reservoir; (2) the electrical field E is turned off or suitably modified so that selected species particles 21-*i* are detached from 20-*i* adjacent to the first electrode surface by the drag force, and the remainder of the general medium and non-bound selected particles (one, two or more species) adjacent to the first electrode surface are collected in a second selected species reservoir; and (3) the strongly bound reactants 21-*i*, which remain attached to the reacting substance 20-*i* on the surface of NSEA sub-array 14-*i*, can be measured by monitoring a sustained electrical impedance change between the NSEA 14-I and the second electrode 17. The electrical impedance can be measured with the same applied non-constant voltage 18 used in DEP, an AC voltage with different magnitude and/or frequency, a constant DC voltage (chronoamperometry), or a constant DC current (chronopotentiometry).

When a reactant 21-*i* becomes bound to the functionalized substance 20-*i* on the insulating material surface of sub-array 14-*i*, an electrical property, such as electrical impedance, electrical conductance or electrical capacitance, having a value Z(bound) (likely due to presence of the selected species particle) between NS electrodes 14-I and the second electrode 17 will manifest a changed value relative to the corresponding value Z(unbound) that is measured before the particles are injected with the fluidic flow. The electrical property value Z(bound) can be also measured between at least two NS electrodes, at 14-(*i*) where the selected particles is bound and Z(unbound) at 14-(*j*) where no reactant is bound. The change in the value of difference, i.e. Z(bound)−Z(unbound), reflects the presence of the selected species particles in the fluidic flow. The unbound value Z(unbound) is likely to be much higher than the bound impedance value for impedance, because the primary path for electrical conduction between the NS electrodes and the liquid or fluid 19 is partially blocked. Thus, if the measured value Z(meas) is substantially different from a reference value, Z(unbound) or Z(ref), this indicates that a reactant 21-I (likely, the selected species particle) is present in the liquid or fluid 19 and is bound in at least one location on the exposed surface 14ES. Where the density, as grown, of the NS electrodes on the sub-array 14-I can be controlled and estimated, the measured difference, |Z(ref)−Z(meas)|or measured ratio |Z(ref)−Z(meas)I/Z(ref) or other measured difference value ΔZ(meas), may be compared with a threshold value, ΔZ(thr) and used to estimate a numerical concentration value (in particles per $cm^2$) of the reactant molecules that are bound on the surface 14ES of the insulating material.

The invention can serve as a sensor for presence of a selected species particle, where it is unknown-whether the liquid or fluid contains the selected species particle and this particle is known to be DEP-positive. The functionalizing substance for the insulating material surface is preferably chosen to promote attachment thereto of only the selected species particle whose presence or absence is to be determined. Attachment of one or more of the selected species particles to the functionalized region is then determined by a separate measurement.

Where Z(meas) is substantially the same as Z(ref) (e.g., within a few percent of Z(ref)), this indicates that substantially no reactant 21-*i* is bound to the exposed surface associated with the sub-array 14*i*; and thus that none or relatively few of the selected particle species are present in the liquid or fluid 19. Where Z(meas) is substantially different from Z(ref), this indicates that a reactant 21-I (presumably, the selected species particles) is bound to the exposed surface 14ES associated with the sub-array 14-*i*; and that a substantial amount of the reactant 21-*i* is present in the liquid or fluid 19. Used in this manner, the invention serves as a sensor for presence or absence of the reactant (or the selected species particles).

In one embodiment of the application to incorporate electrical impedance sensor into the DEP device, the medium is changed to a "testing liquid" with the different conductivity and chemical contents from the original fluid that carries the selected species particles. The measured electrical impedance Z(meas) is compared to a reference value. The reference value, either Z(ref) on the same NS electrode 14-*i* before the selected particle injection or on another NS electrode 14-*i*2 that does not bind with the selected species particle, are all measured in the same "testing liquid".

The "testing liquid" may be salt solutions with different conductivities without any electrochemically active species so that the electrical impedance may be dominated by "non-Faradaic" conduction mechanism. The bound selected particles may provide electrochemical reactant and thus give additional Faradaic signals. The "testing solution" may also be salt solutions containing electrochemically active species so that the electrical impedance is dominated by the Faradaic conduction mechanism. These embodiments provide all needed means to detect the binding of the selected species particles, which may be electrochemical inert blocking agents or may be active reactants.

Figure 3:
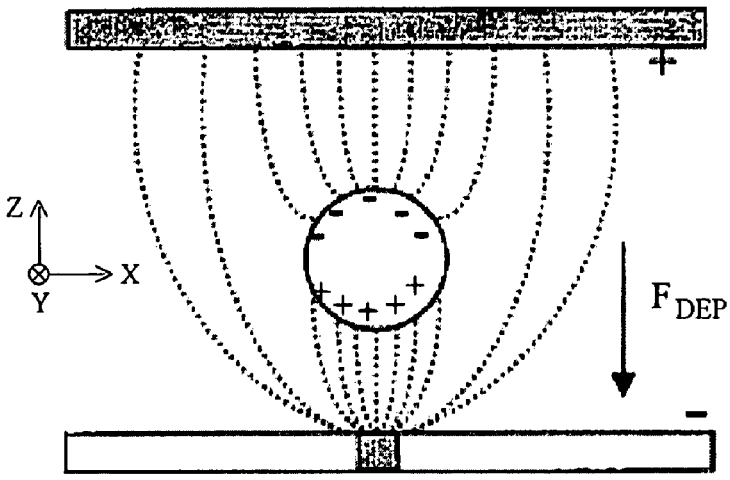
FIG. 3 schematically illustrates dielectrophoresis (DEP) force(s) acting on a polarizable particle.
Figure 4:
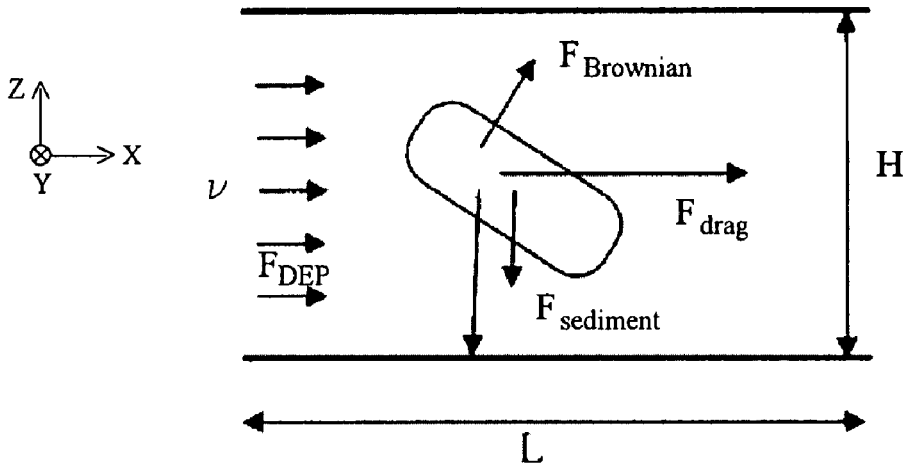
FIG. 4 schematically illustrates four separate forces acting on a particle in a microfluidic channel with length L, height H, and flow velocity U.
Figure 5A:
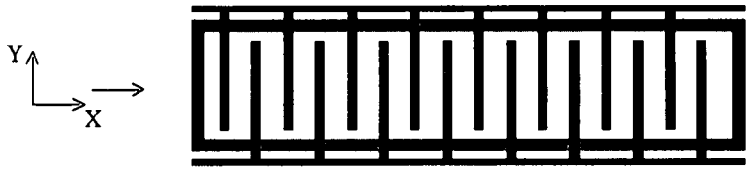
FIGS. 5(*a*)-5(*e*) illustrate the top view of electrode layout at the bottom of the fluidic channel.
Figure 5B:
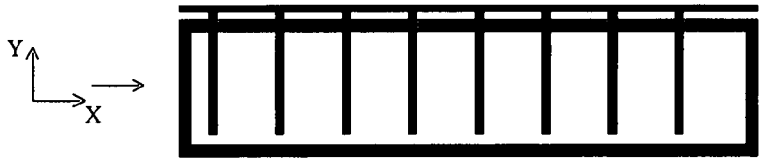
Figure 5C:
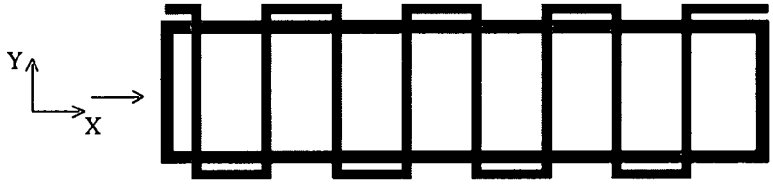
Figure 5D:
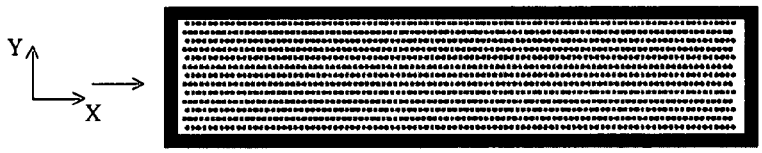
Figure 5E:
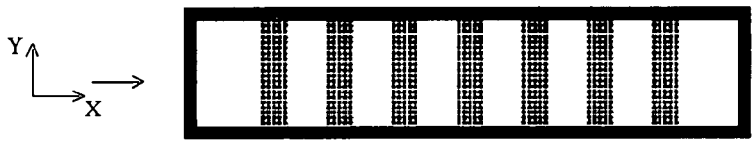

DEP is discussed by H. A. Pohl in Jour. Appl. Phys., vol. 22 (1951) pp 869-871. In most situations, the amount of DEP-caused deposit, for equal time intervals, is proportional to $\nabla(E^2_{rms})$, where $E^2_{rms}$ is the root-mean-square value of electrical field intensity at the applied frequency, works best with polarizable particles (charged or uncharged). An electrophoretic force or electrostatic force, by contrast, depends upon electric field direction, requires electrically charged particles, and deposit is proportional to the first power of the magnitude of E (no the gradient of $E^2_{rms}$), for equal time intervals. The DEP force used here can be expressed as $$F(\mathrm{DEP})=2\pi a^3\in_0\in_m \mathrm{Re}\{\in_p^*-\in_m^*)/(\in_p^*+2\in_m^*)\}\nabla(E^2_{rms}), \quad (1)$$

where a is particle radius, $\in_0$ is dielectric permittivity of free space, and $\in_p^*$ and $\in_m^*$ are complex dielectric permittivities for the selected particle and for the medium, respectively. The selected species particle (and, optionally, the medium) are assumed to be polarizable, but need not have a net electrical charge thereon. FIG. 3 schematically illustrates the net DEP force(s) acting on a polarizable particle. Assuming that the dielectric coefficient of the selected particle ($\in_p$) and of the medium ($\in_m$) satisfy $\in_p>\in_m$, a positive DEP force will develop in the direction of changing electrical field intensity $E^2$, and particles of the selected species will accumulate adjacent to the exposed surface 14ES.

The total vector force F acting on the selected species is a sum of: DEP force; Stokes drag force F(drag)=6πkηαν, where k>1 is a nondimensional factor to account for the channel wall effects, η is the dynamic viscosity of the fluid, and ν is the flow velocity); sedimentation force; and Brownian motion force, $$F=F(\mathrm{DEP})+F(\mathrm{drag})+F(\mathrm{sedimentation})+F(\mathrm{Brownian}), \quad (2)$$

where the sedimentation force is often negligible and the Brownian motion force is random and often averages to 0 over a short time interval. FIG. 3 schematically illustrates these four forces acting on a particle.

The selected species may be *E. coli*, anthrax, salmonella, tobacco mosaic virus, herpes simplex, a bacterium or other biospecies, for which the relative dielectric constant ∈(ω; rel)= 100-1,000,000 at the voltage frequencies employed, so that DEP separation in the presence of water (∈(ω;rel)=55-80) is easily achieved.

FIGS. 5(*a*) 5(*b*) and 5(*c*) are representative microelectrode DEP layouts from the prior art. In FIG. 5(*a*), both the first and second electrodes are microelectrodes which are laid at the bottom of the microfluidic channel and are interdigitated with each other. In FIGS. 5(*b*) and 5(*c*), parallel microelectrodes are laid at the bottom of the microfluidic channel and used as the first electrode vs. a second macroelectrode at the top of the fluidic channel. The adjacent electrode-electrode spacing at the bottom of the fluidic channel is between 1 and 10 μm and electrode width is between 2 and 1000 μm. FIGS. 5(*d*) and 5(*e*) illustrate the NSEA (first electrode) constructed according to an embodiment of this invention. Both FIGS. 5(*d*) and 5(*e*) use an NAEA at the bottom of the fluidic channel as the first electrode vs. a second macroelectrode at the top of the channel. FIG. 5(*d*) uses a single NSEA, while 5(*e*) uses separately addressed multiple NSEAs.

Figure 6A:
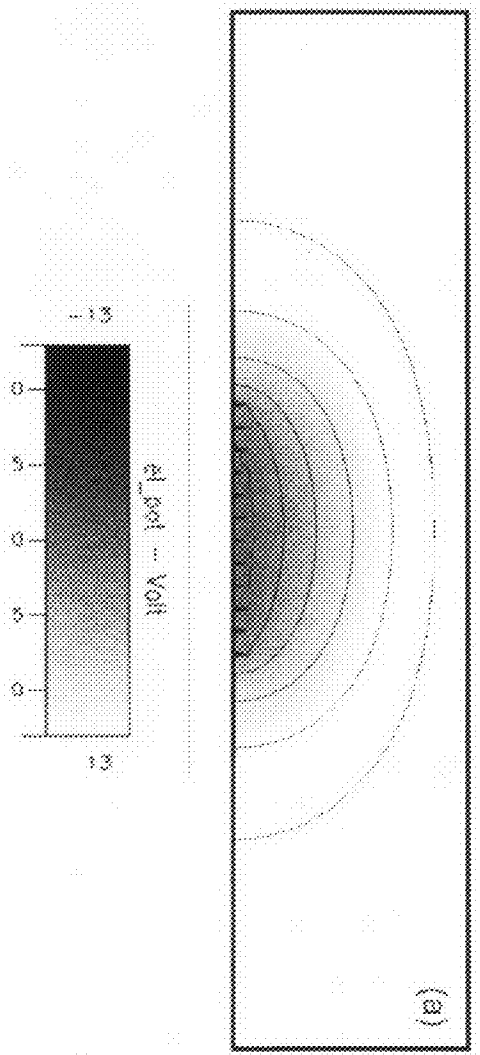
FIGS. 6(*a*) and 6(*b*) illustrate two-dimensional electric potential distribution in an inlaid linear NSEA (1×12): Electric potential distribution Φ plot (6(*a*)) and $E^2$ plot (6(*b*)). The channel dimensions are 102 μm (length) and 20 μm (height). The electrode width and spacing are 200 nm and 2 μm, respectively. The amplitude of the voltage applied is 26 Volts and the frequency is 100 kHz.
Figure 6B:
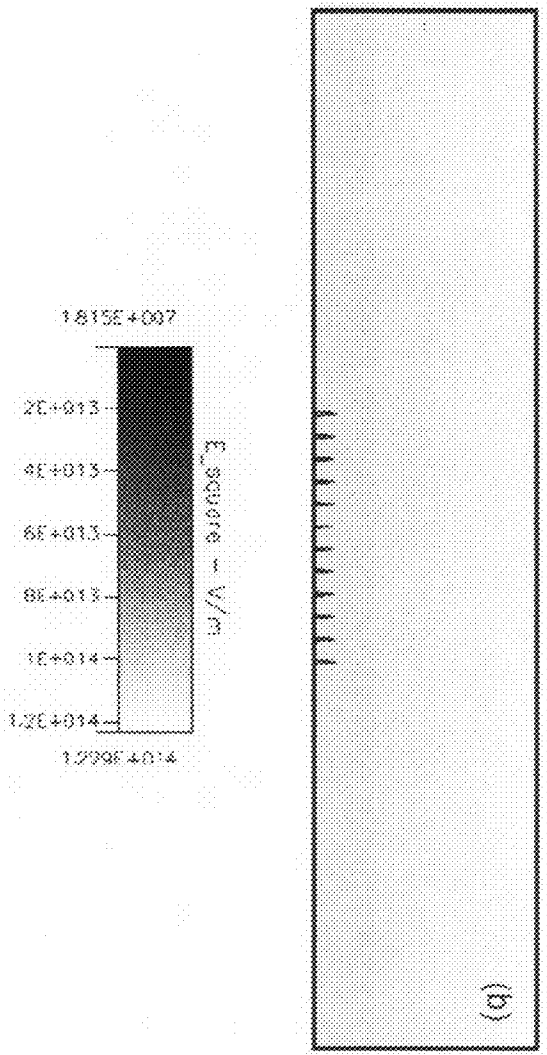

Numerical simulations performed adjacent to the NSEA 14 and the second electrode 17 from FIG. 1 derive the electropotential distribution between these pair of electrodes (FIG. 6(*a*)). This simulation indicates that the gradient of the electrical field intensity $E^2_{rms}$ is extremely asymmetric and highly focused adjacent to an exposed tip of an electrode 14-(*i*,*j*) in the NSEA. It gives a larger magnitude normal to the exposed surface 14ES than parallel to it (FIG. 6(*b*)).

Figure 7A:
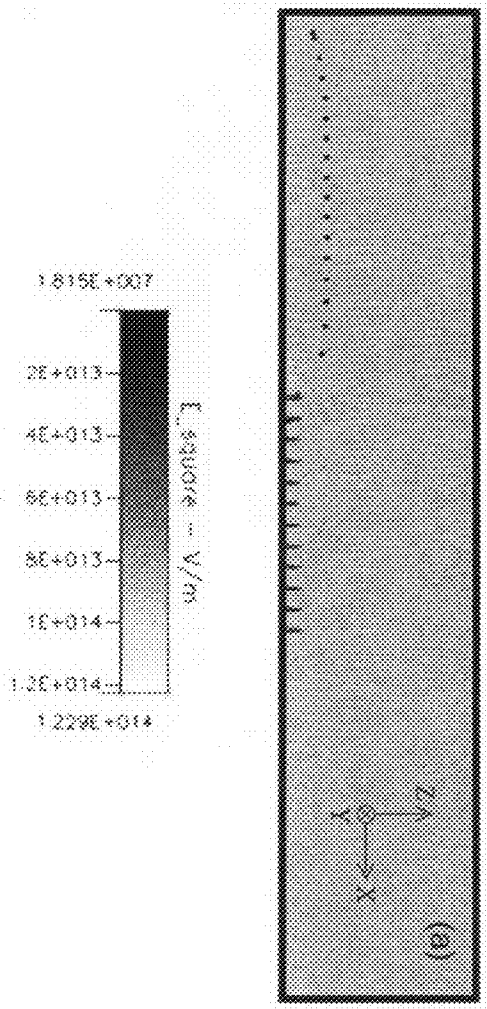
FIGS. 7(*a*) and 7(*b*) illustrate the particle trajectory injected at different channel heights and subjected to the DEP forces from the NSEA at the bottom of the channel. The 1 μm-diameter particles are injected at 3 μm (7(*a*)) and 10 μm (7(*a*)) above the bottom of the channel, respectively. The particle permittivity and conductivity are $10^6$ and 0.013 S/m; the medium permittivity and conductivity are 80 and 0.00018 S/m, respectively. An inlaid linear, regularly spaced NSEA (1×12) with a width of 200 nm and spacing of 2 μm is used in the numerical simulation. The amplitude of the applied voltage is 26 Volts and the frequency is 100 kHz. The channel dimensions are 102 μm (length) and 20 μm (height).
Figure 7B:
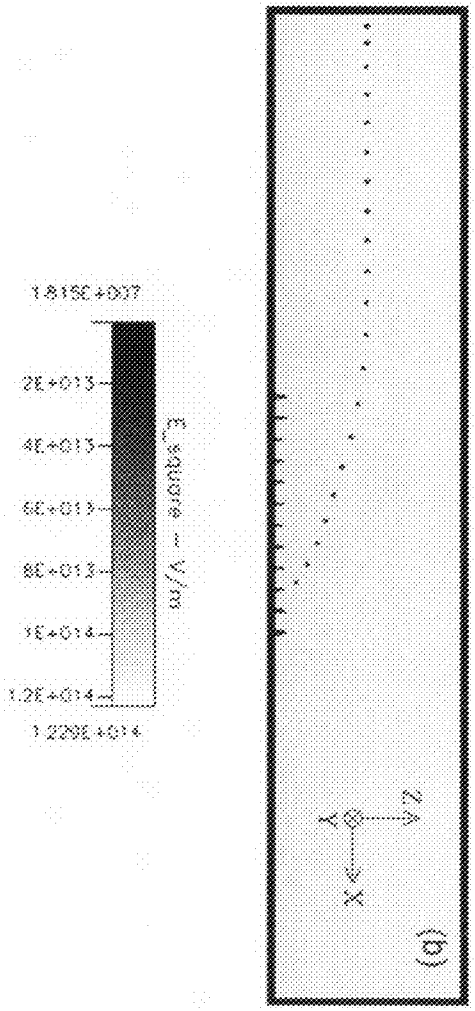

FIGS. 7(*a*) and (7(*b*) illustrate the trajectories of 1 μm diameter particles derived by numerical simulations, with the particles injected at different distances from the first electrode surface. These particles are subjected to the DEP forces from the NSEA at the bottom of the channel. The 1 μm-diameter particles are injected at 3 μm and 10 μm above the bottom of the channel, respectively. The particle dielectric constant and conductivity are $10^6$ and 0.013 S/m; the medium dielectric constant and conductivity are 80 and 0.00018 S/m. Hence, the selected particle is DEP-positive. An inlaid linear, substantially regularly spaced NSEA (1×12) with a width of 200 nm and spacing of 2 μm is used in the numerical simulation. The peak-to-peak amplitude of the applied voltage is 26 Volts and the frequency is 100 kHz. The channel dimensions are 102 μm (length) and 20 μm (height). The particles closer to an exposed tip of an electrode 14-(*i*,*j*) of a NSEA are subjected to a bigger DEP force and are quickly defected toward the NSEA. Most of the particles are trapped adjacent to a first or second exposed tip as the particles pass by. The particles injected into the channel at locations further from an exposed tip of an electrode 14-(*i*,*j*) of a NSEA are subjected to smaller DEP forces and hence deflect at a smaller rate. Hence, these particles travel down stream in the fluid channel for a longer distance before they are trapped adjacent to an electrode 14-(*i*,*j*). The DEP device will be optimized with proper voltage amplitude, frequency, and electrode layout so that the lateral travel distance can be minimized before they the selected species particles are trapped at an electrode 14-(*i*,*j*).

Figure 8A:
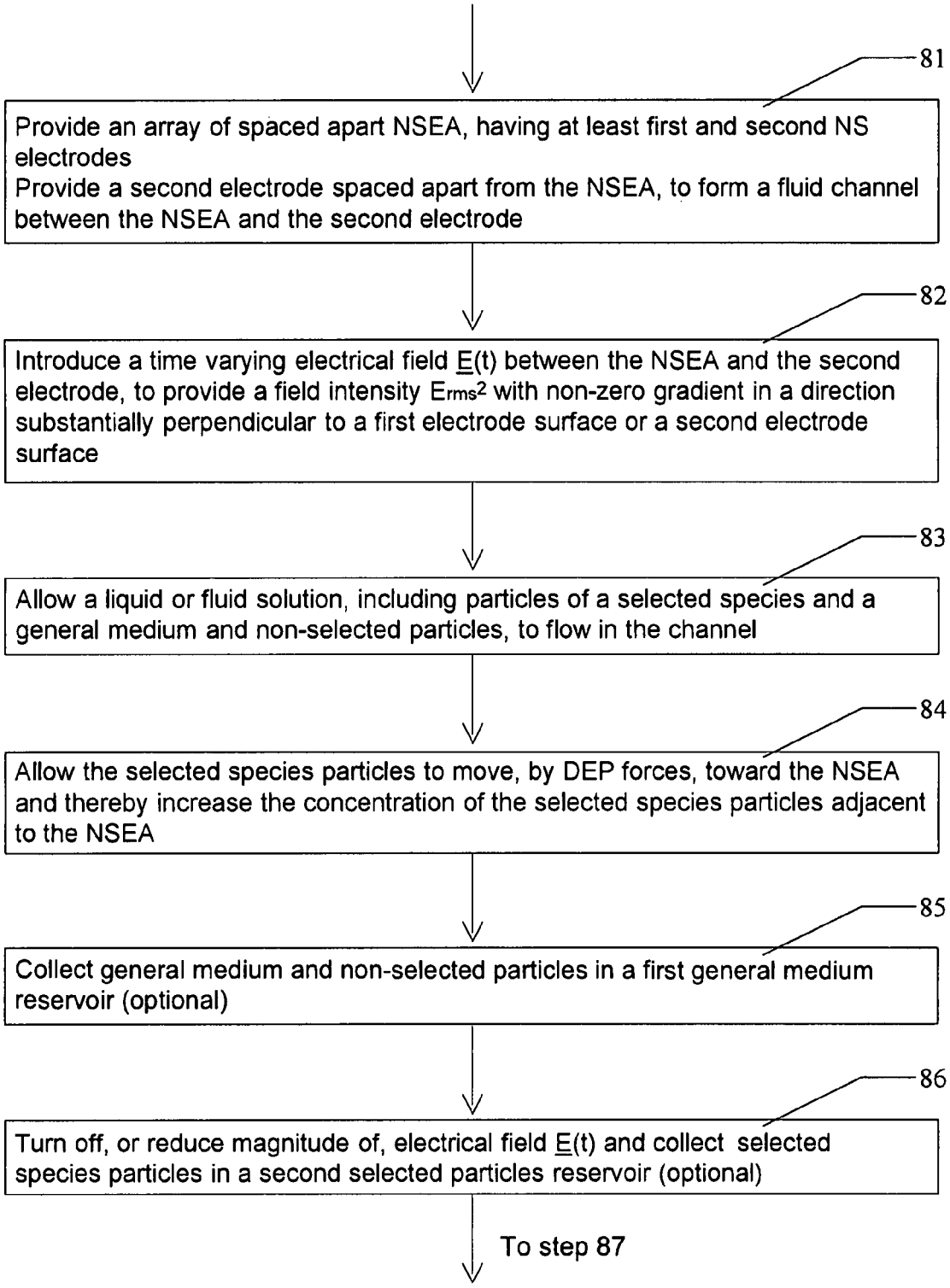
FIGS. 8(*a*) and 8(*b*) are a flow chart of a procedure for practicing the two embodiments of the invention as shown in FIGS. 1 and 2.
Figure 8B:
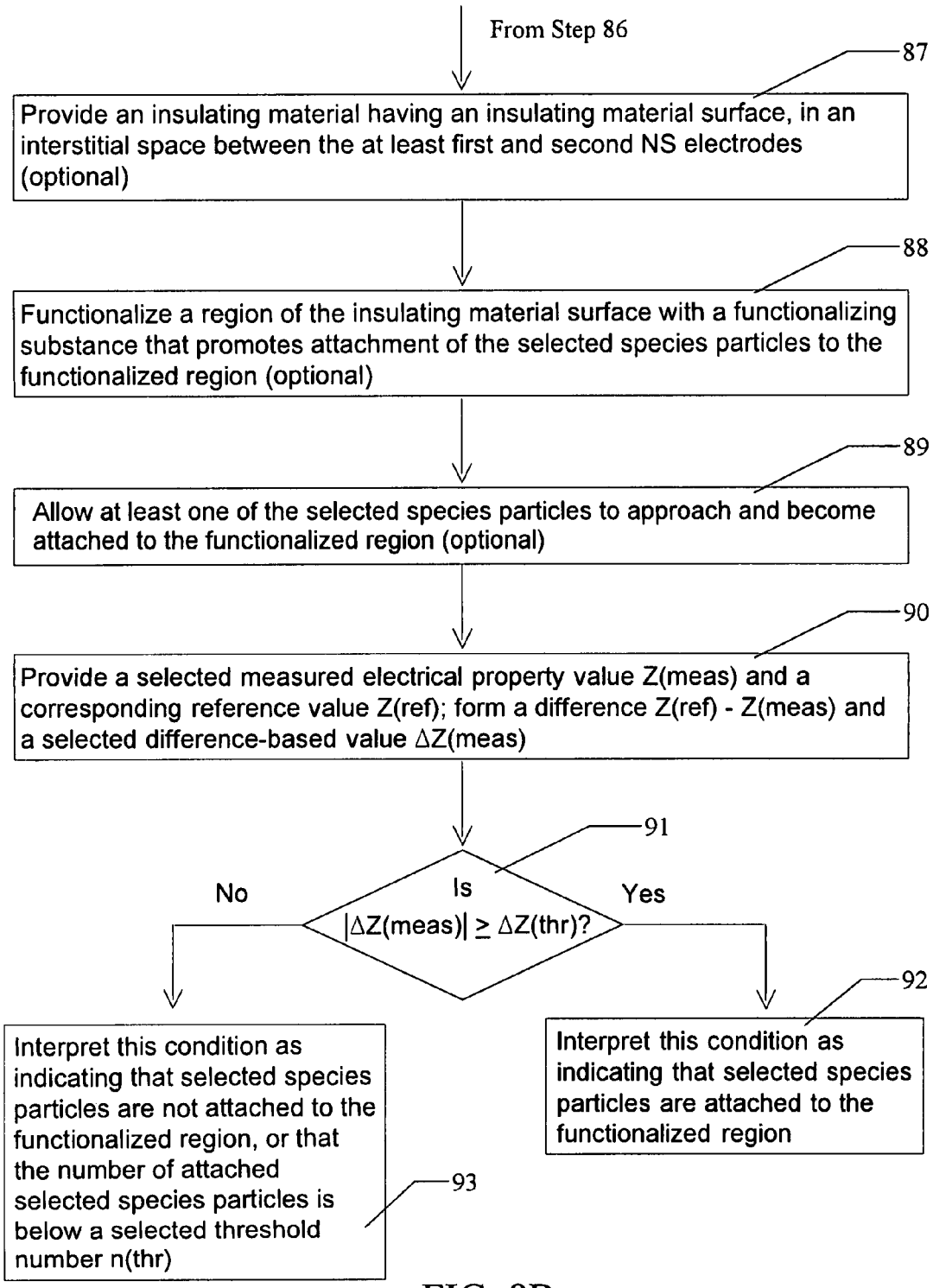

FIG. 8 is a flow chart of a procedure for practicing an embodiment of the invention. In step 81, a first electrode including an array of spaced apart nanostructure electrodes ("NSEA") is provided, having at least first and second NS electrodes, and a second electrode is provided, spaced apart from the NSEA, to form a channel between the two electrodes. In step 82, a time varying electrical field E(t) is introduced between the NSEA first electrode and the second electrode to provide an electrical field intensity $E^2_{rms}$ with non-zero gradient in a direction substantially perpendicular to a first or second electrode surface. In step 83, a liquid or fluid including particles of a selected species and a general liquid or fluid medium are allowed to flow in the channel. In step 84, the selected particles are allowed to move, by DEP forces, toward, and thereby increase concentration of the selected particles adjacent to, the NSEA. In step 85 (optional), the general medium and non-selected particles in the medium are received in a first general medium reservoir. In step 86 (optional), the electrical field E is turned off or suitably modified so that selected species particles no longer accumulate adjacent to the first electrode surface, and the selected species particles (with increased concentration relative to the original concentration in the general medium) are received in a second selected species reservoir.

In step 87, an insulating material, having an insulating material surface, is provided in an interstitial space between the at least first and second NS electrodes. In step 88, a region of the insulating material surface is functionalized with a functionalizing substance that promotes attachment of the selected species particles to the functionalized region. In step 89 (optional), at least one of the selected species particles is allowed to approach and become attached to the functionalized region. In step 88 (optional), first and second spaced apart regions of the insulating material surface can be functionalized with respective first and second functionalizing substances that promote attachment of first and second selected species particles, respectively, so that distinct first and second selected species particles in the liquid are attracted to and attached at the first and second functionalized regions of the insulating material surface.

In step 90, a value Z(meas) of a selected electrical property (e.g., electrical impedance, electrical conductance or electrical capacitance) is measured and a difference, Z(ref)−Z(meas) is formed between the measured value and a reference value for this electrical property. The value Z(ref) may, for example, be the value Z that would be measured if none of the selected species particle is attached to the functionalized region. In step 91, a selected difference-based value ΔZ(meas), such as Z(ref)−Z(meas) or {Z(ref)−Z(meas)}/Z(ref) or a linear or nonlinear combination thereof, is formed and compared with a threshold value ΔZ(thr). If |ΔZ(meas)|>ΔZ(thr), the system interprets this condition as indicating that selected species particles are attached to the functionalized region (and a fortiori are present in the liquid or fluid), in step 92. If |ΔZ(meas)|<ΔZ(thr), the system interprets this condition as indicating that selected species particles are not attached to the functionalized region, or the number of selected species particles that are attached is below a selected threshold number n(thr), in step 93.

What is claimed is:

1. A method for testing for presence of particles of a selected species in a liquid or fluid, the method comprising:

providing an array of at least first and second spaced apart nanostructure ("NS") electrodes that are part of a first electrode surface;

providing a second electrode, spaced apart from the first electrode surface by a distance in a selected distance range, to thereby form a channel between the first electrode surface and the second electrode;

impressing a time varying electrical field E(t) between the NS electrodes and the second electrode to provide a root-mean-square electrical filed intensity $E^2_{rms}$ with non-zero gradient in a direction (z) substantially perpendicular to the first electrode surface;

allowing a liquid or fluid, which may contain particles of a selected species and includes at least one of a general medium and non-selected particles, to flow in the channel;

allowing the selected species particles, when present, to move, by dielectrophoresis forces, toward, and to thereby increase concentration of the selected species particles adjacent to, the NS electrodes;

providing an electrically insulating material, having an insulating material surface, in an interstitial space between said at least first and second NS electrodes, where a portion of at least one of said NS electrodes is exposed at or adjacent to the insulating material surface;

providing a first functionalizing substance on a first region of the insulating material surface, which promotes attachment of said selected species particles, when present, to the first region;

allowing at least one of the selected species particles, when present, to approach and become attached to the first region;

providing a measured value Z(meas) of a selected electrical property of at least one of the first and second NS electrodes, providing a reference value Z(ref) for the selected electrical property, and providing a value ΔZ(meas) based on a difference between Z(ref) and Z(meas);

when $|\Delta Z(meas)| \geqq \Delta Z(thr)$ is satisfied, where Z(thr) is a selected threshold value, interpreting this condition as indicating that the selected species particle is present in the liquid or fluid; and when $|\Delta Z(meas)| < \Delta Z(thr)$, interpreting this condition as indicating that the selected species particles are not present, or are present below a selected threshold concentration, in the liquid or fluid.

2. The method of claim 1, further comprising choosing said electrical property from the group consisting of electrical impedance, electrical conductivity and electrical capacitance.

3. The method of claim 1, further comprising providing said difference value ΔZ(meas) from the group of difference-based values consisting of (i) Z(ref)−Z(meas), (ii) {Z(ref)−Z(meas)/Z(ref) and (iii) a combination of (i) and (ii).

4. The method of claim 1, further comprising covering an end, closest to said second electrode, of at least one of said first NS electrode and said second NS electrode with a thin layer, of thickness no more than about 50 nanometers, of said insulating material.

5. The method of claim 1, further comprising choosing said insulating material to include at least one of $SiO_2$, $Si_3N_4$, paralyne and epoxy.

6. The method of claim 1, further comprising choosing said range of said distance to include 1-1000 μm.

7. The method of claim 1, further comprising providing said electrical field E(t) so that said intensity $E^2_{rms}$ decreases monotonically along said z direction.

8. The method of claim 1, further comprising choosing said time varying electrical field E(t) to have a sinusoidal component sin ωt with an angular frequency ω in a range $600\text{-}6\times10^8$ rad/sec.

9. The method of claim 1, further comprising providing said NS electrodes as an array of substantially regularly spaced NS electrodes.

10. The method of claim 1, further comprising providing said NS electrodes as a plurality of electrode fingers extending in a selected direction.

11. The method of claim 1, further comprising providing said NS electrodes as a polygonal array of said electrodes extending in said z direction.

12. The method of claim 1, further comprising choosing said selected species of particles from a group consisting of *E. coli*, anthrax, salmonella, tobacco mosaic virus, herpes simplex, a bacterium, nano-particles, micro-particles, quantum dots, nanowires and nanotubes.

13. The method of claim 1, further comprising collecting at least one of said general medium and said non-selected particles in a general medium reservoir after said general medium and said non-selected particles have flowed through said channel.

14. The method of claim 1, further comprising:

removing or reducing said intensity of said electrical field E(t); and collecting at least one of said selected species particles, when present, in a selected species reservoir.

15. A system for testing for presence of particles of a selected species in a liquid or fluid, the system comprising:

an array of at least first and second spaced apart nanostructure ("NS") electrodes that are part of a first electrode surface;

a second electrode, spaced apart from the first electrode surface by a distance in a selected distance range, to thereby form a channel between the first electrode surface and the second electrode;

a source of a time varying electrical field E(t), impressed between the NS electrodes and the second electrode to provide a root-mean-square electrical filed intensity $E^2_{rms}$ with non-zero gradient in a direction (z) substantially perpendicular to the first electrode surface;

a liquid or fluid, which may contain particles of a selected species and includes at least one of a general medium and non-selected particles, that is introduced and allowed to flow in the channel, where the selected species particles, when present, are allowed to move, by dielectrophoresis forces, toward, and to thereby increase concentration of the selected species particles adjacent to, the NS electrodes;

an electrically insulating material, having an insulating material surface, positioned in an interstitial space between said at least first and second NS electrodes, where a portion of at least one of said NS electrodes is exposed at or adjacent to the insulating material surface;

a first functionalizing substance, located on a first region of the insulating material surface, which promotes attachment of said selected species particles, when present, to the first region, where at least one of the selected species particles, when present, is allowed to approach and become attached to the first region; and a computer that is programmed:

to receive or provide a measured value Z(meas) of a selected electrical property of at least one of the first and second NS electrodes, to provide a reference value Z(ref) for the selected electrical property, and to provide a value ΔZ(meas) based on a difference between Z(ref) and Z(meas);

when $|\Delta Z(meas)| \geqq \Delta Z(thr)$ is satisfied, where Z(thr) is a selected threshold value, to interpret this condition as indicating that the selected species particle is present in the liquid or fluid; and when $|\Delta Z(meas)| < \Delta Z(thr)$, to interpret this condition as indicating that the selected species particles are not present, or are present below a selected threshold concentration, in the liquid or fluid.

16. The system of claim 15, wherein said electrical property is chosen from the group consisting of electrical impedance, electrical conductivity and electrical capacitance.

17. The system of claim 15, wherein said difference value ΔZ(meas) is chosen from the group of difference-based values consisting of (i) Z(ref)−Z(meas), (ii) {Z(ref)−Z(meas)}/Z(ref), and (iii) a combination of (i) and (ii).

18. The system of claim 15, wherein an end, closest to said second electrode, of at least one of said first NS electrode and said second NS electrode is covered with a thin layer, of thickness no more than about 50 nanometers, of said insulating material.

19. The system of claim 15, wherein said insulating material includes at least one of $SiO_2$, $Si_3N_4$, paralyne and epoxy.

20. The system of claim 15, further comprising choosing said range of said distance to include 1-1000 μm.

21. The system of claim 15, wherein said electrical field E(t) is provided so that said intensity $E^2_{rms}$ decreases monotonically along said z direction.

22. The system of claim 15, wherein said time varying electrical field E(t) is provided with a sinusoidal component sin ωt with an angular frequency ω in a range $600\text{-}6\times10^8$ rad/sec.

23. The system of claim 15, further comprising providing said NS electrodes as an array of substantially regularly spaced NS electrodes.

24. The system of claim 15, wherein said NS electrodes comprise a plurality of electrode fingers extending in a selected direction.

25. The system of claim 15, wherein said NS electrodes comprise a polygonal array of said electrodes extending in said z direction.

26. The system of claim 15, wherein said selected species of particles is chosen from a group consisting of *E. coli*, anthrax, salmonella, tobacco mosaic virus, herpes simplex, a bacterium, nano-particles, micro-particles, quantum dots, nanowires and nanotubes.

27. The system of claim 15, further comprising a general medium reservoir, positioned to collect at least one of said general medium and said non-selected particles after said general medium and said non-selected particles have flowed through said channel.

28. The system of claim 15, further comprising a selected species reservoir, positioned to collect at least one of said selected species particles, when present, after said intensity of said electrical field is removed or reduced.

* * * * *

UNITED STATES PATENT AND TRADEMARK OFFICE

CERTIFICATE OF CORRECTION

PATENT NO. : 7,635,420 B1
APPLICATION NO. : 11/645267
DATED : December 22, 2009
INVENTOR(S) : Li et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 563 days.

Signed and Sealed this

Twenty-first Day of December, 2010

David J. Kappos

David J. Kappos
*Director of the United States Patent and Trademark Office*